United States Patent [19]

Gauffin et al.

[11] Patent Number: 4,513,551

[45] Date of Patent: Apr. 30, 1985

[54] STRUCTURAL SUPPORT

[76] Inventors: Ulf Gauffin, Dagermansgatan 6, S-754 28 Uppsala; Mikael Hellsten, Lärkvägen 29, S-185 00 Vaxholm, both of Sweden

[21] Appl. No.: 480,729

[22] Filed: Mar. 31, 1983

[30] Foreign Application Priority Data

May 12, 1982 [SE] Sweden ..... 8202993
Feb. 16, 1983 [SE] Sweden ..... 8300873

[51] Int. Cl.[3] ..... E04C 3/16
[52] U.S. Cl. ..... 52/364
[58] Field of Search ..... 52/361-364, 52/670-675; 29/6.1

[56] References Cited

U.S. PATENT DOCUMENTS

| | | | |
|---|---|---|---|
| 1,701,304 | 2/1929 | Jones | 52/675 |
| 2,553,363 | 5/1951 | Droeger | 52/145 |
| 2,706,315 | 4/1955 | Price | 52/364 |
| 3,108,406 | 10/1963 | Ellis | 52/670 |
| 3,129,792 | 4/1964 | Gwynne | 52/364 |
| 3,270,472 | 9/1966 | Gilbert | 52/364 |
| 3,309,119 | 3/1967 | Phillips | 52/670 |
| 4,085,558 | 4/1978 | Albrecht | 52/674 |

FOREIGN PATENT DOCUMENTS

| | | | |
|---|---|---|---|
| 695911 | 10/1964 | Canada | 52/364 |
| 266405 | 11/1968 | Sweden | 52/364 |

*Primary Examiner*—James L. Ridgill, Jr.
*Attorney, Agent, or Firm*—Kinzer, Plyer, Dorn & McEachran

[57] ABSTRACT

A structural support made of sheet metal or like material has a surface (2,3) intended to support a building panel or some other structural member, which is secured to the surface by means of screws or like fasteners. In order to reduce the force required to drive the screws or like fasteners, such as nails, into the support, the aforementioned surface is provided with closely lying weakened areas within a fastening area (9,10), the points of the fasteners being guided into the weakened areas by inclined surfaces adjacent thereto.

2 Claims, 6 Drawing Figures

STRUCTURAL SUPPORT

The present invention relates to a structural support made, for example, of sheet metal and intended to support a building panel or some other structural member which can be fastened to a surface on the support by means of nails, screws or similar fasteners, said surface having therein weakened portions for receiving said fasteners.

Structural supports of this kind are known from, for example, CH-A-619 035, which describes a structural support provided with fastener-receiving apertures. The apertures are spaced relatively widely apart, and consequently each nail or screw must be placed in a specific position on a panel in order for the point of the fastener to engage the aperture in the support, said aperture naturally being hidden by the panel. If the fastener strikes to one side of the aperture in the support, a fresh attempt must be made. Structural supports of this kind are only suitable for use when securing panels, shelving brackets or other structural members which have been pre-drilled.

Normal supports of this kind, used for example in inside walls or partition walls, and in ceiling structures, are made from sheet steel. The material thickness of a sheet-steel structural support is about 0.5–3.0 mm. When a panel is to be secured to such a support, there is normally used special, hardened self-tapping steel screws, having points capable of being forced through the plate. Despite the use of special screws, the force required to drive the self-tapping screws lies within a range of 25–35 kp, placing much strain on the workman, particularly since normally 5000 screws are required each day. Consequently, those workmen whose task it is to set up the panels etc., often suffer from such ailments as aching arms and backs.

One object of the invention is to provide a structural support where the force required to drive a screw thereinto is only about 1–5 kp, thereby greatly lowering the individual strain on the joints and muscles of the arms, shoulders and back of the workmen.

Another object of the invention is to provide a structural support formed from a relatively small amount of material, and therewith a support of relatively light weight, and which enables the use of inexpensive fasteners and has low energy-transmission properties, especially with respect to the transmission of acoustic energy.

These and other objects are fully realized by means of the present invention, which is defined in the following claims and an embodiment of which is described hereinafter with reference to the accompanying drawings, in which FIG. 1 is a sectional view of a structural support having a panel secured on both sides thereof, by means of screws;

Figure 1:
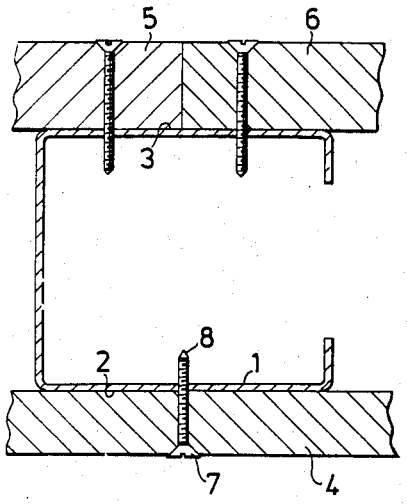

FIG. 1 is a sectional view of an inside wall or partition wall of a building, said wall comprising a plurality of sheet-metal supports 1 having surfaces 2 and 3 which, in the illustrated embodiment, are shown to be planar, but which may have any suitable form and may, for example, be corrugated. These surfaces 2 and 3 are intended to support thereagainst structural elements, such as shelving brackets or, as in the illustrated case, building panels 4, 5 and 6, comprising, for example, plaster board or metal facing panels or ceiling/roofing panels or the like. Conventionally, the panels, such as the panel 4 are secured by means of screws 7, which have a specially formed point 8, which when a large axial force is imparted to the screw, for example a force of 25 kp, cuts through the metal and forms an opening, into which the self-tapping screw can be screwed.

Figure 2:
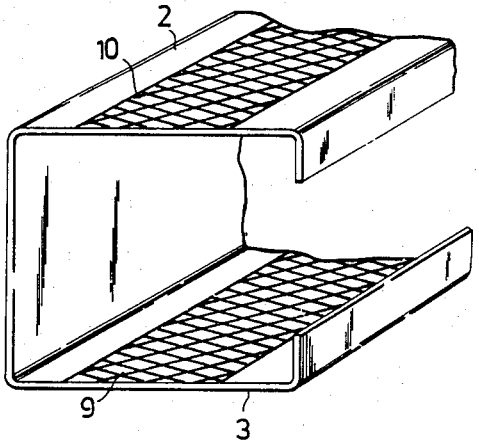
FIG. 2 is a perspective view of a structural support according to the invention.
Figure 3:
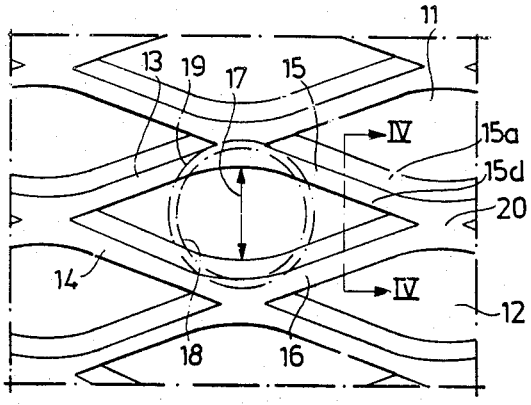
FIG. 3 is an enlarged view of a region of the support where fasteners are intended to be placed, said region comprising expanded metal.
Figure 4:
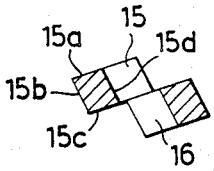
FIG. 4 is a sectional view taken on the line IV—IV in FIG. 3.

FIG. 2 illustrates a structural support of substantially C-shaped cross-section and of the same kind as that shown in FIG. 1. In this embodiment, however, the structural support is provided with fastening areas 9 and 10 on both planar surfaces 2 and 3. As will best be seen from the enlarged views in FIGS. 3 and 4, these fastening areas comprise perforated areas on the support. In the FIG. 3 embodiment, the fastening areas 9 and 10 comprise areas of expanded metal, forming rhomboidal apertures, such as apertures 11 and 12. Each aperture is defined by narrow metal bands 13, 14, 15 and 16. The size of the screw or like fastener used to secure the sheet or building panel to the structural support is adapted to the smallest dimension 17 of the aperture. FIG. 3 illustrates in cross-section a screw having a core 18 and threads 19. When the screw enters the aperture and begins to screw into the panel, the core 18 will force out the aperture, defining bands 13, 14, 15 and 16, and the screw will obtain a positive grip. The force required to drive in the screw is relatively small, for example from 1–5 kp. If the point of the screw should come into contact with metal lying adjacent an aperture, for example into contact with the metal shown at the location 20, the point will be guided into the adjacent aperture, so that the screw or like fastener is firmly seated in the manner desired. In accordance with the invention, this guiding of the end of a fastener is ensured by inclining the material surfaces between the apertures, as illustrated in FIG. 4. Inter alia, FIG. 4 is a sectional view of the band 15, which is shown to have a rectangular cross-sectional shape. In manufacturing the grid, all bands, for example the band 15, have been rotated about their longitudinal axes, so that the surfaces **15*a*, 15*b*, 15*c* and 15*d* are inclined to the direction in which the fastener is driven. Consequently, if the end of a screw, nail or like fastener engages the structural support on one side of an aperture, the material engaged by the end of said fastener will not be pressed inwardly, which might exclude the possibility of effectively driving home the fastener, but will be moved sideways by the laterally acting force presented through the nearest inclined surface. When seen theoretically, this means that either the fastener can move laterally slightly, into the panel, or corresponding movements take place by stretching and compression laterally in the fastening surface on the structural support. This latter is constructed to take up such movement, since the material can be stretched in the propagation plane. As will be understood, even when the diameter of the core 18 is larger than the smallest aperture dimension 17**, the only requirement is for the threads of the screw to engage the edges of the aperture.

Figure 5:
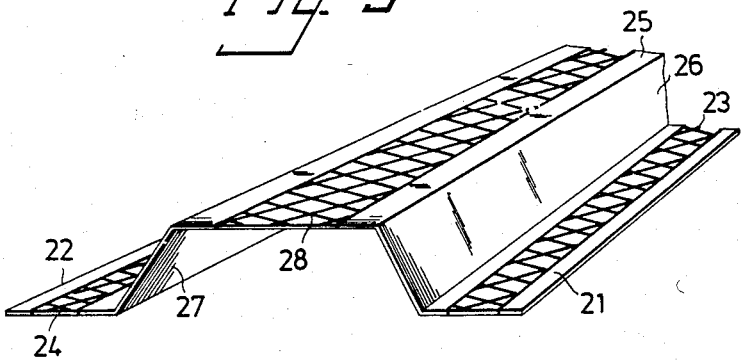
FIG. 5 illustrates another form of structural support, intended to support ceiling or roofing sheets or panels.

FIG. 5 illustrates an embodiment of a structural support having two flanges 21 and 22 which are intended to be secured to a ceiling or like structure, each of the flanges of the illustrated structural support being provided with fastener-receiving areas 23 and 24 in accordance with FIGS. 3 and 4. A fastening surface 25 is provided with a weakened area 28 by means of bent sections 26, 27.

In regions located between the perforated areas 23, 24, 28, the metal support is continuous, so as to obtain the maximum stability and rigidity in the structural support.

As will be understood, the structural support illustrated in FIG. 2 can well be manufactured totally from expanded metal or from any other type of perforated metal sheet.

Figure 6:
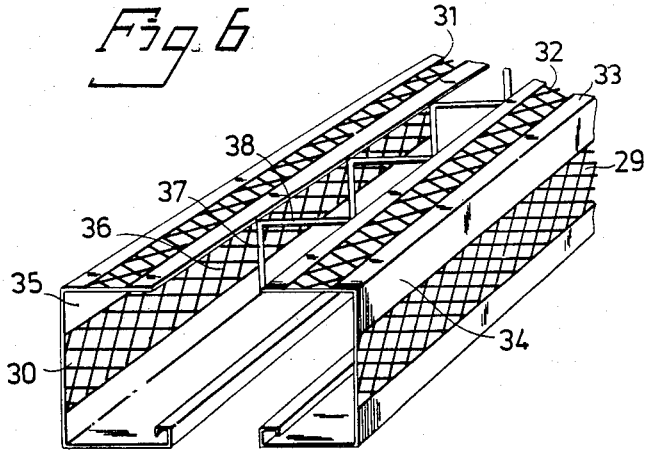
FIG. 6 illustrates a third embodiment of a structural support according to the invention.

FIG. 6 illustrates a structural support of a kind which includes fastener-receiving areas 29 and 30, and areas 31 and 32 on the web 33, which are formed in a manner to save material and which are separated from the areas 29 and 30 by means of stiff angle plates 34 and 35, for greatly stiffening the structural support. Between the two perforated areas 31 and 32 of the web 33, which perforations may, for example, have the same dimensions as the perforations within the fastening areas 29 and 30, there is arranged along the support an area 36 which is similar to the other areas and which includes preferably thin strips, for example strips 37 and 38, which hold the support together and which are formed in accordance with an expanded metal technique. These strips 37 and 38 can be readily clipped off or knocked away when drawing, for example, electric cables into the wall and, because of the small amount of material within the area 36, cause the transmission of energy from one side of the support to the other to be greatly reduced. This support connecting area 36 can, of course, be formed in a different way, for example, by punching rectangular pieces from the metal sheet, to leave thin, readily broken strips. The weakened portions also enable the structural supports to be clipped and holes for installation lines to be made therein much more readily.

In the aforegoing it has been assumed that the structural support is made from a homogenous material, for example sheet metal, although it is also conceivable to use composite material. For example, practical experiments have shown that tubular beams made of paper-board which is coated with, for example, a thermosetting resin, subsequent to pressing a grid of, for example, the kind shown in FIG. 3, firmly into the paper-board material, preferably on the inside of the beam, exhibits sufficient strength and stability to be used, for example, in the construction of partition walls and inner walls in a building.

The structural support, or at least those parts thereof which form fastener-receiving surfaces for such fasteners as screws, nails etc., may have the form of a net structure of desired mesh size. The net structure may, for example, be constructed from metal wires or rods welded together to form meshes of, for example, rectangular configuration.

In the aforegoing the invention has been described with reference to the construction of buildings. As will be understood, however, the invention can also be applied in all cases where a structural member or the like is to be fastened to a structural support. For example, there are widely used in the electronic industry frame structures or chassis to which such components as transformers, circuit blocks etc., are screwed. In this case the chassis forms the aforedescribed structural support and is provided with weakened areas according to the invention. There is also found a need for the invention in the car-manufacturing industry, the invention enabling components to be mounted, for example, on the car body more simply and more readily, the car body forming, in this case the described support member, in which fastener-receiving weakened areas are formed at desired locations when pressing the body platework.

We claim:

1. A structural support made of sheet metal, for example, for supporting a building panel or other structural member which is to be fastened to a surface on the support by means of screws, nails and like fasteners, said surface having an expanded metal portion, the expanded metal portion having elongated apertures each defined by narrow yieldable bands of metal, each narrow yieldable band of metal having surface portions inclined to the direction in which the fastener is driven to form fastener slide paths which will guide the point of the fastener into an aperture, the smallest dimension of each aperture being less than the diameter of the fastener so the fastener will force apart the metal bands forming an aperture as it is driven into said surface to firmly seat the fastener in the aperture.

2. The structural support of claim 1 characterized in that the apertures are rectangular or rhomboidal in shape.

* * * * *